US006508064B2

(12) United States Patent
Tomita

(10) Patent No.: US 6,508,064 B2
(45) Date of Patent: Jan. 21, 2003

(54) TABLETOP WHITE SMOKE GENERATOR USING DRY ICE

(75) Inventor: Mizuho Tomita, Tachikawa (JP)

(73) Assignee: Throne International Service Co., Ltd., Tokyo (JP)

( * ) Notice: Subject to any disclaimer, the term of this patent is extended or adjusted under 35 U.S.C. 154(b) by 0 days.

(21) Appl. No.: 09/982,962

(22) Filed: Oct. 22, 2001

(65) Prior Publication Data

US 2002/0050141 A1 May 2, 2002

(30) Foreign Application Priority Data

Oct. 31, 2000 (JP) ..... 2000-333564
May 7, 2001 (JP) ..... 2001-136466

(51) Int. Cl.[7] ..... F17C 7/04; F17C 7/02
(52) U.S. Cl. ..... 62/48.1; 62/50.1
(58) Field of Search ..... 62/50.2, 48.1; 239/2.1; 261/36.1

(56) References Cited

U.S. PATENT DOCUMENTS 3,736,261 A * 5/1973 Bjornerud et al. ..... 422/306
4,771,608 A * 9/1988 Liu et al. ..... 62/48.1
5,220,637 A * 6/1993 Levin et al. ..... 392/396
5,368,787 A * 11/1994 Yonamoto et al. ..... 239/434
5,610,359 A * 3/1997 Spector et al. ..... 102/334
5,649,427 A * 7/1997 Sawada et al. ..... 62/48.1
5,711,481 A * 1/1998 MacDonald et al. ..... 239/14.1
5,957,382 A * 9/1999 Thomas ..... 239/135

FOREIGN PATENT DOCUMENTS

JP 6-166586 6/1994

* cited by examiner

*Primary Examiner*—William C. Doerrler
(74) *Attorney, Agent, or Firm*—Armstrong, Westerman & Hattori, LLP.

(57) ABSTRACT

A tabletop white smoke generator using dry ice includes a water tank that is formed by a metal into a receptacle with an open upper side, has a vacuum empty portion formed in the inside of a bottom portion and a sidewall so that hot or cold water can be filled into the receptacle; a dry ice accommodating receptacle that is formed into a receptacle with an open upper side, the receptacle being of a size that can be accommodated within the water tank, wherein dry ice can be accommodated in the receptacle; and a holding portion, which holds the dry ice accommodating receptacle above the water tank, and which with a specific operation can submerge the dry ice accommodating receptacle into the warm water that has been filled into the water tank. A tray can be arranged above the water tank, and submerging the dry ice into the warm water generates dry ice white smoke that gushes out from below the tray.

10 Claims, 13 Drawing Sheets

TABLETOP WHITE SMOKE GENERATOR USING DRY ICE

This application claims benefit of Japanese Application No. 2000-333564 filed in Japan on Oct. 31, 2000, and Japanese Application No. 2001-136466 filed in Japan on May 7, 2001, the contents of which are incorporated by this reference.

BACKGROUND OF THE INVENTION

1. Field of the Invention

The present invention relates to a tabletop white smoke generator which is placed on a table and can easily generate dry ice white smoke for enjoyment.

2. Description of Related Art

Conventionally, white smoke (water vapor) has been generated by adding cold or warm water to dry ice during, for example, various types of shows such as musical performances, and parties, such as wedding receptions, to liven up the festivities with a cloud-like smoke that floats around the guests' feet or flows down like a waterfall from behind them.

Devices used for generating this dry ice white smoke were generally large-scale devices that included a dry ice accommodation portion, a warm water supply device, and a ventilation device, for example, and which moreover directed large amounts of generated white smoke to desired locations using a piping system.

These large smoke-generating devices, however, had to be set up in a location separate from the event venue, and thus the white smoke had to be delivered to the event venue via a smoke conduit or blowers, for example, so that they were troublesome and expensive to operate, upkeep, and manage.

A white smoke generating device other than those devices in which the above piping system is used has been proposed in JP H06-166586A. This white smoke generating device includes a dry ice chamber inside and to the bottom of an outer casing, a warm water chamber inside and to the top of that outer casing, a connection path for delivering warm water from inside the warm water chamber down into the dry ice chamber, a stopper portion that can be removed from the outside of the outer casing, and a white smoke guide path in communication with the upper surface of the upper lid of the outer casing from the top portion of the dry ice chamber. A white smoke generator with this configuration can be directly placed in an event venue, for example, and moreover it has the advantage that it does not require a piping system or the like for delivering the white smoke.

In either case, however, the above white smoke generating devices using dry ice were large devices, and could not be casually placed on a tabletop to generate white smoke for entertainment. Moreover, with conventional white smoke generating devices using dry ice, hot water must be used so that when the dry ice is introduced to the water a large amount of water vapor white smoke is generated, and thus it is necessary to provide insulation for the hot water.

SUMMARY OF THE INVENTION

An object of the present invention is to provide a tabletop white smoke generator that can be placed on top of a dining table and with which large amounts of dry ice white smoke (vapor white smoke) can be generated easily which can be emitted or made of float around for entertainment purposes, and moreover which is capable of having a tray with a cake, for example, placed above its smoke generating portion without the generated smoke coming down on the cake.

A further object of the present invention is to provide a tabletop white smoke generator that uses dry ice, in which the tabletop white smoke generator has a simple structure with improved insulation for the hot or cold water for generating the dry ice white smoke, which does not cause heat-related damage to the table on which it is placed, and furthermore to which water drops do not stick, and which poses no harm, even if its outer surface is touched.

A further object of the present invention is to provide a tabletop white smoke generator which is configured so that when the dry ice and warm or cold water interact to generate a large amount of vapor smoke, the large amount of cold or warm water that is spattered does not come into contact with the table on which the generator is placed.

The tabletop white smoke generator of the present invention is provided with a water tank that is formed by a metal receptacle with an open upper side, in which an empty portion for vacuum thermal insulation is formed by the inner portion of a bottom portion and a sidewall, wherein hot or cold water can be filled into the receptacle; a dry ice accommodating receptacle that is formed into a receptacle with an open upper side, the receptacle being of a size that can be accommodated within the water tank, wherein dry ice can be accommodated in the receptacle; and a holding portion, which holds the dry ice accommodating receptacle above the water tank, and which with a specific operation can submerge the dry ice accommodating receptacle into the hot or cold water that has been filled into the water tank.

The tabletop white smoke generator of the present invention is provided with a water tank that is formed by a metal receptacle with an open upper side, in which an empty portion for vacuum thermal insulation is formed by the inner portion of a bottom portion and a sidewall, wherein hot or cold water can be filled into the receptacle; a flange extending outward from the top of the water tank, on which a tray can be set providing a gap for discharging the generated white smoke in a horizontal direction; a dry ice accommodating receptacle that is formed by a receptacle with an open upper side, the receptacle being of a size that can be accommodated within the water tank, wherein dry ice can be accommodated in the receptacle; and a holding portion, which holds the dry ice accommodating receptacle above the water tank, and which with a specific operation can submerge the dry ice accommodating receptacle into the hot or cold water that has been filled into the water tank.

The above and other objects, features and advantages of the invention will become more clearly understood from the following description referring to the accompanying drawings.

DESCRIPTION OF THE PREFERRED EMBODIMENTS

The following is an explanation of an embodiment of the present invention with reference to the drawings.

Figure 1:
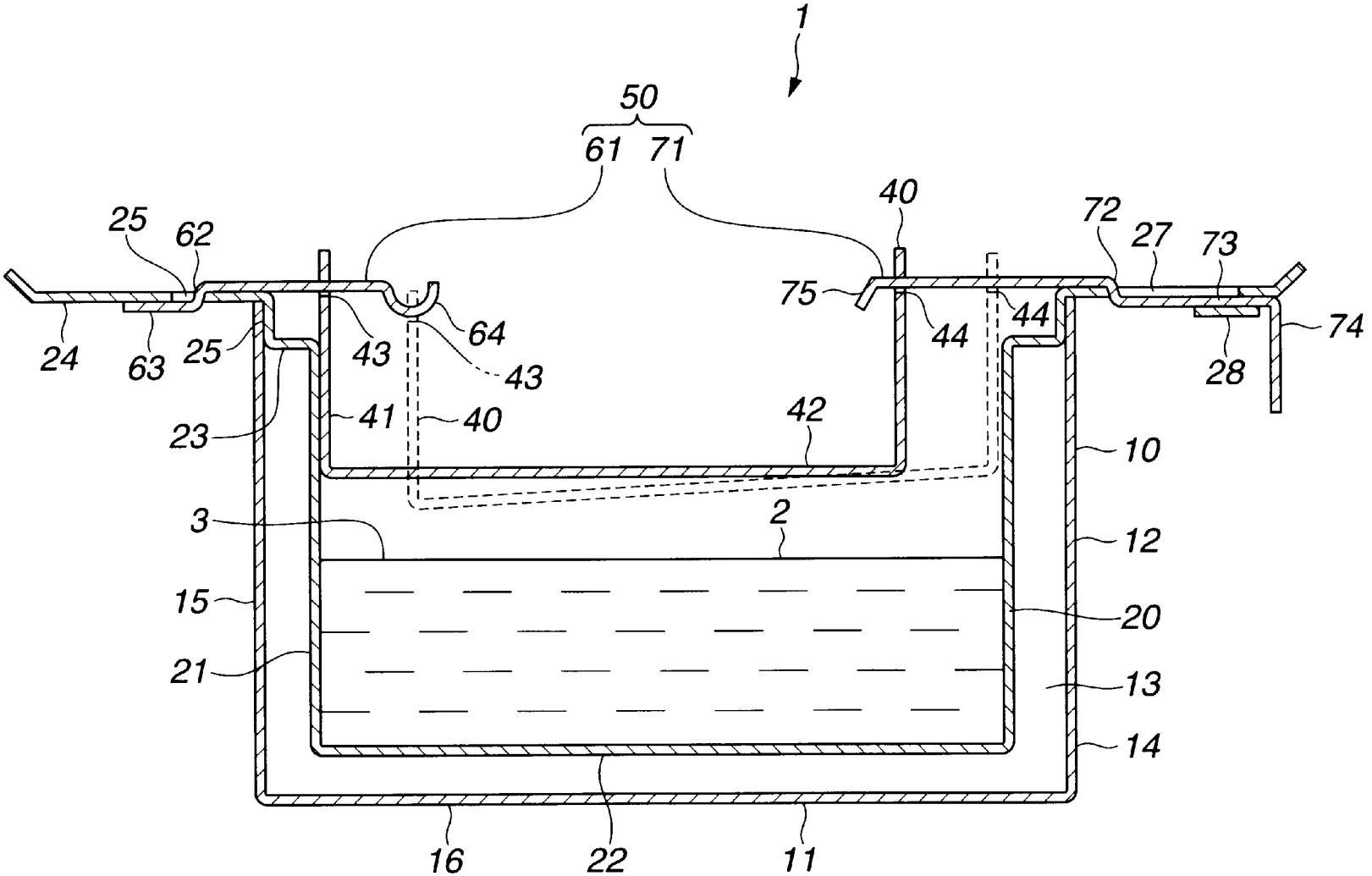
FIG. 1 is a cross-sectional view showing an embodiment of the tabletop white smoke generator according to the present invention.
Figure 2:
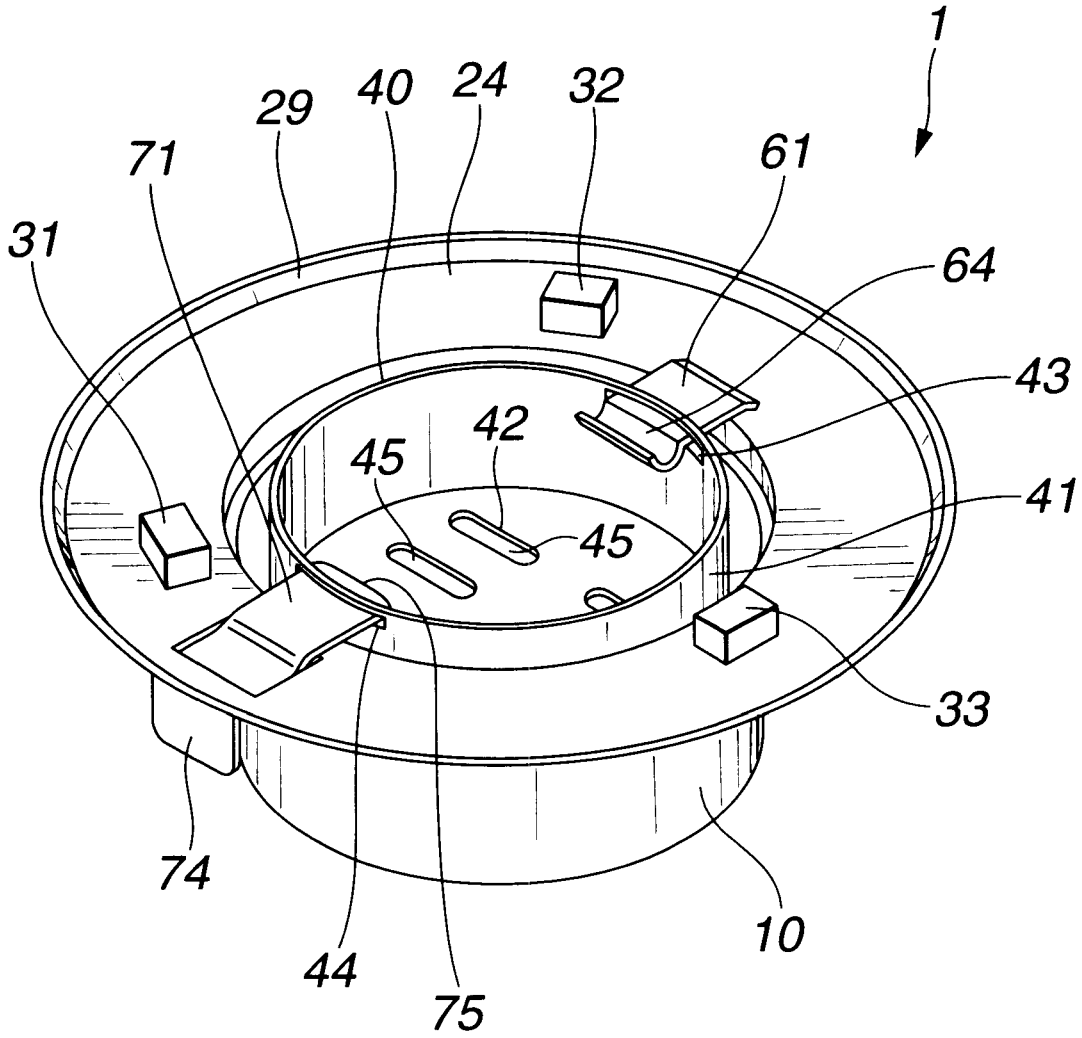
FIG. 2 is a perspective view showing the outside appearance of the tabletop white smoke generator of FIG. 1.
Figure 3:
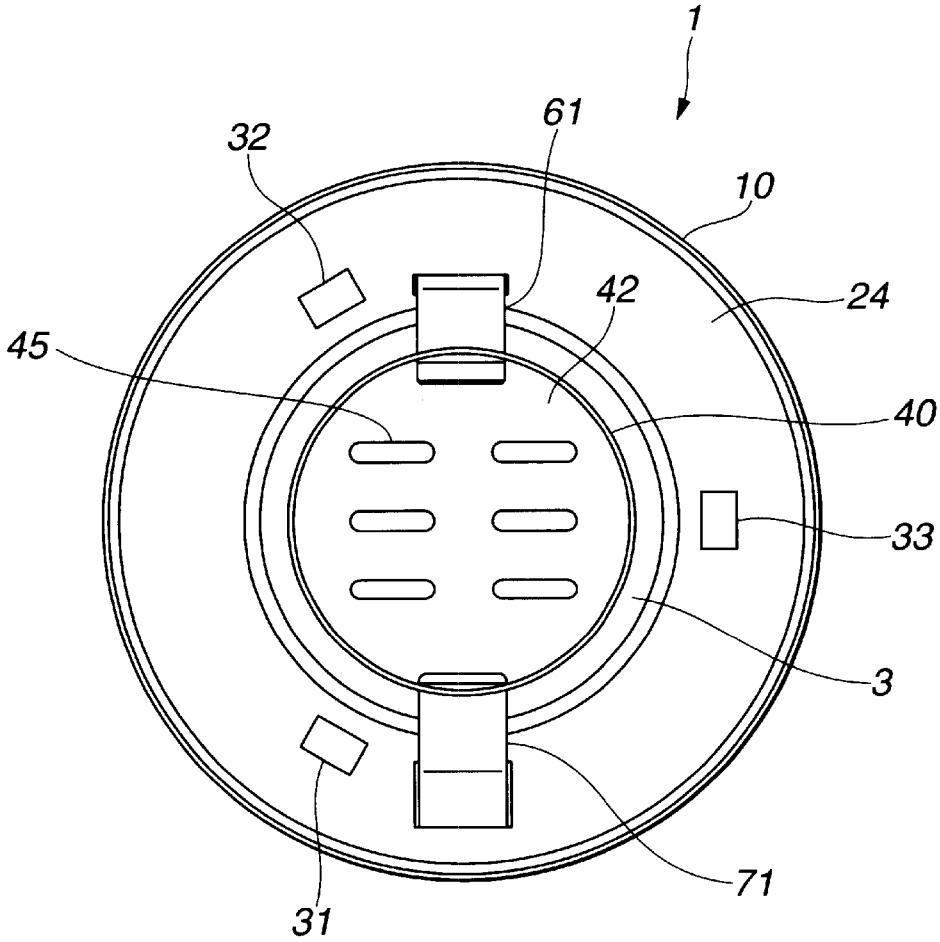
FIG. 3 is a top view of the tabletop white smoke generator of FIG. 1.
Figure 4:
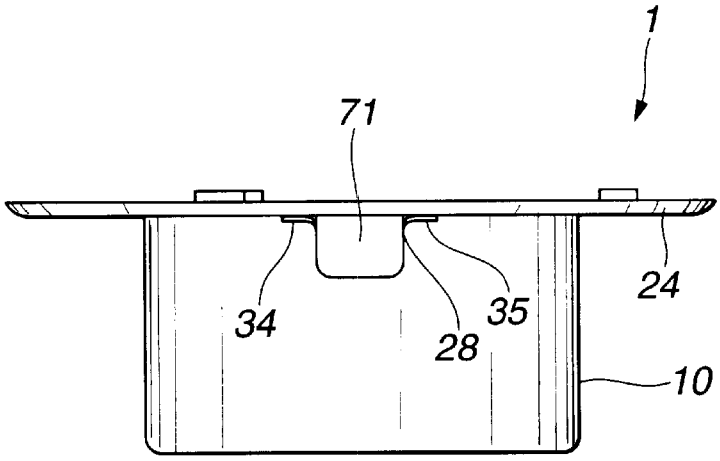
FIG. 4 is a lateral view of the tabletop white smoke generator of FIG. 1 seen from the control portion side.
Figure 5:
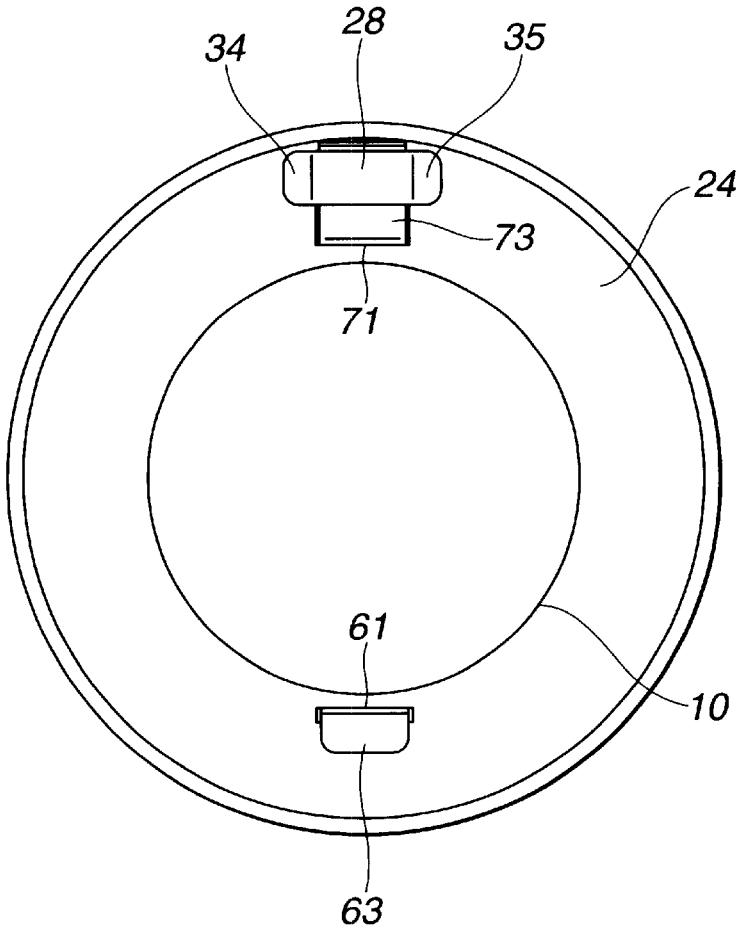
FIG. 5 is a bottom view of the tabletop white smoke generator of FIG. 1.
Figure 6:
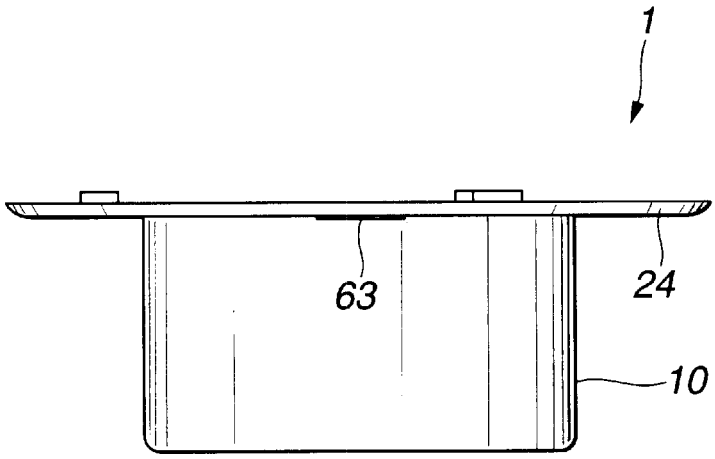
FIG. 6 is a lateral view of the tabletop white smoke generator seen from the rear side of FIG. 4.
Figure 7:
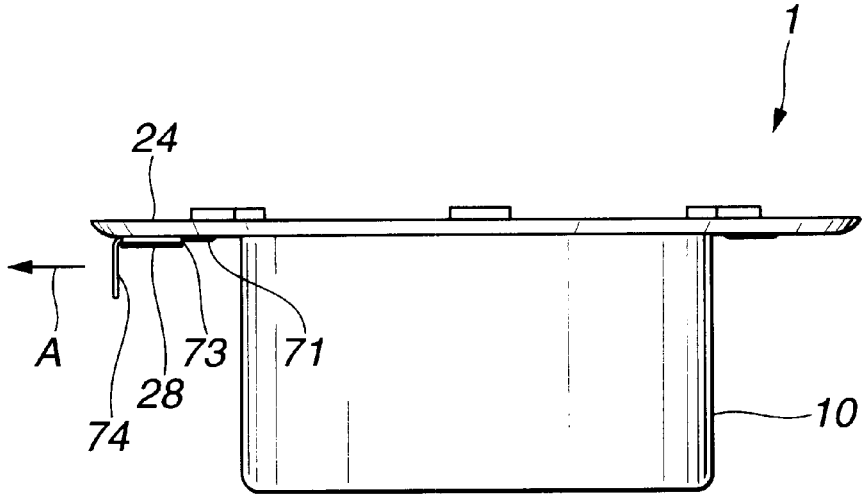
FIG. 7 is a lateral view of the tabletop white smoke generator seen from the right side of FIG. 4.

FIG. 1 through FIG. 8 show an embodiment of a tabletop white smoke generator according to the present invention. FIG. 1 is a cross-sectional view of a tabletop white smoke generator, FIG. 2 is a perspective view showing the outside appearance of that tabletop white smoke generator, FIG. 3 is a top view of that tabletop white smoke generator, FIG. 4 is a lateral view of that tabletop white smoke generator seen from the control portion side, FIG. 5 is a bottom view of that tabletop white smoke generator, FIG. 6 is a lateral view of that tabletop white smoke generator seen from the rear side of FIG. 4, and FIG. 7 is a lateral view of that tabletop white smoke generator seen from the right side of FIG. 4.

In FIG. 1, a tabletop white smoke generator 1 is shaped into a metal (in the case of the present embodiment, stainless steel) receptacle (the receptacle shape can be chosen freely, and can be circular like in the example in FIG. 1, or rectangular or polygonal) with an open upper side. The tabletop white smoke generator 1 includes a water tank 10, a dry ice accommodating receptacle 40, and a holding portion 50. The water tank 10 is capable of storing warm (hot) water 2 and has an empty portion 13 for vacuum thermal insulation formed by the inner side of a bottom portion 11 and a sidewall 12 of the receptacle. The dry ice accommodating receptacle 40 has an opening on its upper side and is of a size that it can be accommodated above the water tank 10. Dry ice can be accommodated in this accommodating receptacle 40. The holding portion 50 holds the dry ice accommodating receptacle 40 above the water tank 10, and with a certain operation, the dry ice accommodating receptacle 40 can be dropped and submerged into the warm water 2 stored in the water tank 10.

The water tank 10 is formed into a single unit by welding together an outer receptacle 14 and an inner receptacle 20. The outer receptacle 14 is made of stainless steel, and is shaped into a receptacle with an open upper side by closing up the lower side of its cylindrical outer side wall 15 with a bottom plate 16.

The inner receptacle 20 is made of stainless steel, has a cylindrical inner sidewall 21 of which the lower side is closed up with a bottom plate 22, and is provided with a flange 24 via a stepped portion 23 extending to the outer periphery above the inner side wall 21. The outer peripheral surface 25 of the stepped portion 23 is welded to the inner periphery of the outer side wall 15 of the outer receptacle 14 by a suitable method such as high-frequency welding.

The bottom portion 11 of the water tank 10 has a dual structure with the bottom plate 16 and the bottom plate 22. Also the side wall 12 of the water tank 10 has a dual structure with the outer side wall 15 and the inner side wall 21.

With this structure, the inner side of the water tank 10 becomes a water storage portion 3 into which the warm water 2 is filled and stored, and the water tank 10 keeps the empty portion 13 for thermal insulation, which is enclosed by the side walls 15 and 21, the bottom plates 16 and 22, and the stepped portion 23, air-tight. Here, in order to create a vacuum in the empty portion 13, it is possible to use a method in which, for example, a pipe from which air has been removed is formed on the outer side wall 15 and connected to a vacuum pump, and after air has been removed from the empty portion 13, the inner wall of the pipe is welded with an appropriate method such as high frequency welding to close the pipe.

The dry ice accommodating receptacle 40 is made of stainless steel and shaped into a receptacle with an open upper side by closing up the bottom side of its cylindrical outer wall 41 with a bottom plate 42. The dry ice accommodating receptacle 40 is of a size that can be accommodated within the water tank 10, and can accommodate dry ice. A pair of opposing slits 43 and 44 are formed near the top of the side wall 41 of the dry ice accommodating receptacle 40.

The holding portion 50 is made of a fixed piece 61 and a movable piece 71. The fixed piece 61 is plate-shaped and made of stainless steel, and is provided with a welded portion 63 at one end via a stepped portion 62. The welded portion 63 extends outward along the bottom surface of the flange 24 via a through hole 26 in the flange 24, and is welded to the bottom surface of the flange 24 with a suitable method such as high frequency welding.

The other end of the fixed piece 61 protrudes over the water storage portion 3 of the inner receptacle 20, and is inserted into the slit 43 of the dry ice accommodating receptacle 40. The tip of this other end of the fixed piece 61 is shaped into a hook portion 64, and the hook portion 64 is configured such that it interlocks with the slit 43 of the dry ice accommodating receptacle 40 when the movable piece 71 is slid to shift the dry ice accommodating receptacle 40 into the position shown in FIG. 1 by the phantom line.

The movable piece 71 is plate-shaped and made of stainless steel, and is provided with a sliding portion 73 at one end via a stepped portion 72. The sliding portion 73 extends outward along the bottom surface of the flange 24 via a through hole 27 in the flange 24, and is slidably attached to the bottom surface of the flange 24 by a holding fixture 28. The tip of the sliding portion 73 is bent downwards to form a control portion 74. The other end of the movable piece 71 extends over the water storage portion 3 of the inner receptacle 20, and is inserted into the slit 44 of the dry ice accommodating receptacle 40. The tip of the other end of the movable piece 71 is formed into,a downward slanting bent portion 75. When the mobile portion 71 is moved outward from the flange 24 by sliding the control portion 74, the bent portion 75 applies a force to the inner side of the dry ice accommodating receptacle 40 and moves it into the position shown by the phantom line in FIG. 1, after which the bent portion 75 is pulled out from the slit 44 of the dry ice accommodating receptacle 40. The control portion 74 of the movable piece 71 protrudes from the lower side of the flange 24.

In FIG. 2, the water tank 10 accommodates the dry ice accommodating receptacle 40 in the open space at the top. The fixed piece 61 and the movable piece 71 are inserted into the. Slits 43 and 44 of the dry ice accommodating receptacle 40. FIG. 2 shows the state before the movable piece 71 is operated. In this state, the slit 43 of the dry ice accommodating receptacle 40 is located closer to the perimeter of the water tank 10 than to the hook portion 64 of the fixed piece 61.

A plurality of slits 45 are formed in the bottom plate 42 of the dry ice accommodating receptacle 40 for allowing the flow of warm water into the inner portion of the dry ice accommodating receptacle 40 when it is submerged in the warm water of the water tank 10. The slits 45 are through hole portions through which the warm water can pass.

An edge portion 29 that slants upward is formed at the periphery of the flange 24 of the water tank 10. Spacers 31, 32, and 33 made of rubber are provided at certain locations on the flange 24 of the water tank 10. Moreover, the white smoke generator 1 is configured such that a tray can be placed on top of the spacers 31, 32, and 33.

In FIG. 3, the fixed piece 61 and the movable piece 71 are disposed in opposing positions on the flange portion 24 so that the dry ice accommodating receptacle 40 can be securely placed above the water storage portion 3. The slits 45 are provided at six locations in the bottom plate 42 of the dry ice accommodating receptacle 40.

As shown in FIG. 4 and FIG. 5, the holding fixture 28 for holding the sliding portion 73 of the movable piece 71 is made of stainless steel and is provided with a welded portion 34 at one end and a welded portion 35 at the other end, the welded portions 34 and 35 being welded to the bottom surface of the flange 24 of the water tank 10 by a suitable method such as high frequency welding.

As shown in FIG. 5 and FIG. 6, the welded portion 63 of the fixed piece 61 is welded to a position in opposition to the movable piece 71 of the flange 24, and the welded portion 63 is formed hardly protruding from the flange 24 so that it can be kept as inconspicuous as possible.

In FIG. 7, the movable piece 71 is configured such that by pulling the control portion 74 in the direction "A" in the drawing, that is, in an outward direction, the sliding portion 73 slides with respect to the flange 24 of the water tank 10 and the holding fixture 28, and the entire movable piece 71 moves.

The operation of the tabletop white smoke generator 1 that is shown in FIG. 1 through FIG. 7 is explained with reference to FIG. 8 and FIG. 9.

Figure 8:
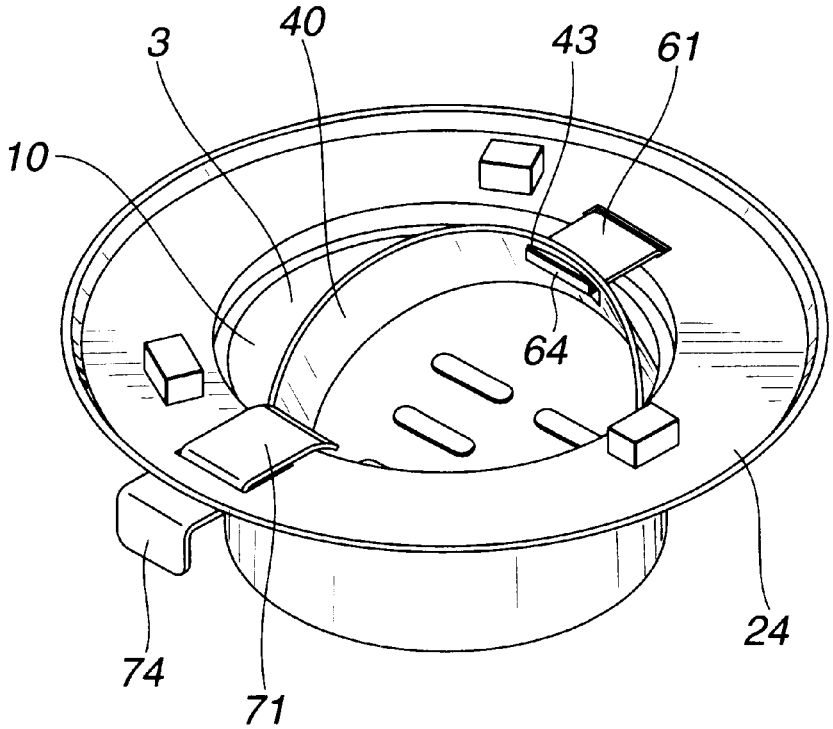
FIG. 8 is a first diagram explaining the operation of the embodiment of the tabletop white smoke generator according to FIG. 1.
Figure 9:
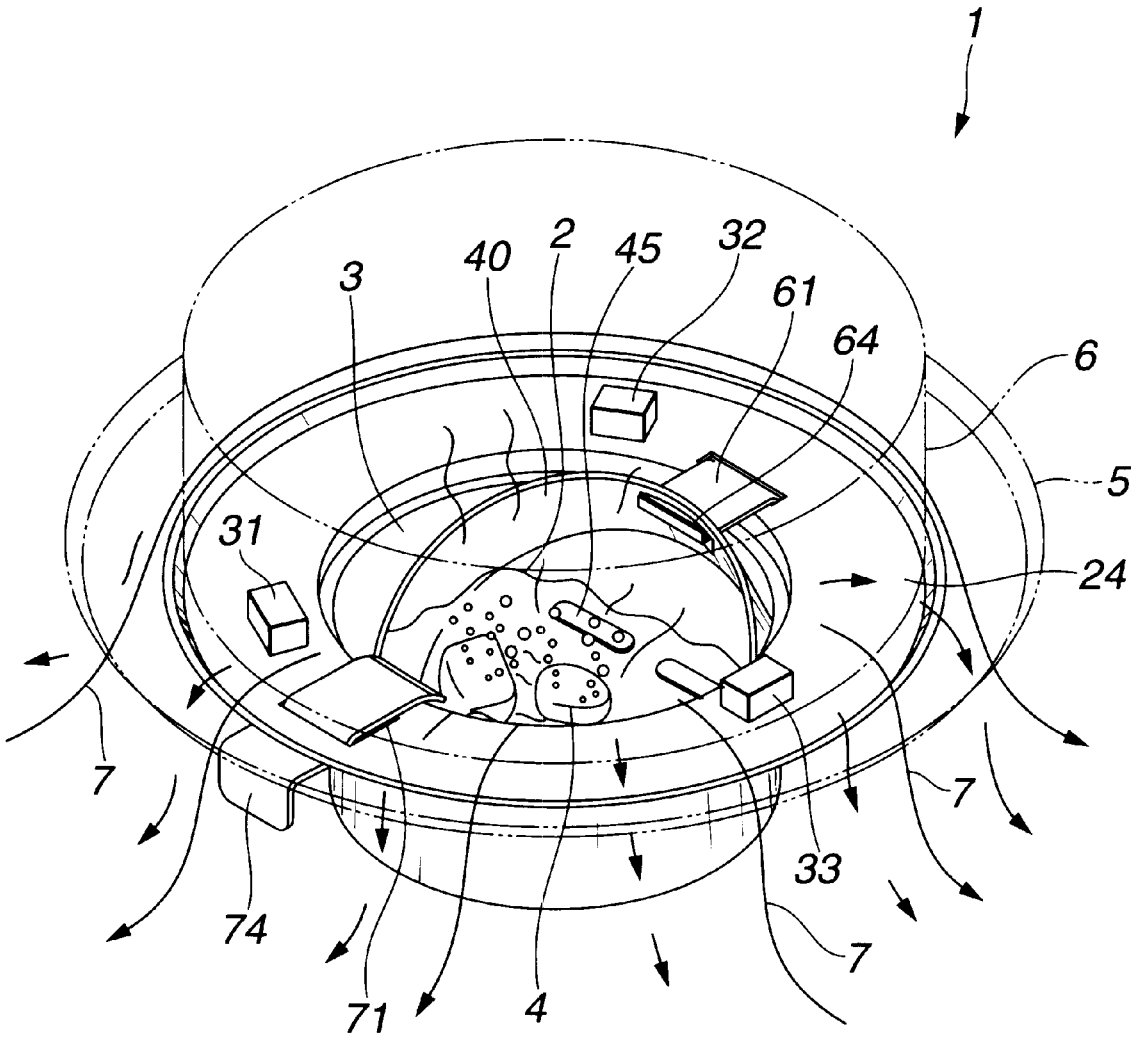
FIG. 9 is a second diagram explaining the operation of the embodiment of the tabletop white smoke generator according to FIG. 1.

FIG. 8 and FIG. 9 are diagrams each illustrating an operation. FIG. 8 shows the operation of manipulating the movable piece 71, while FIG. 9 shows the operation of generating white smoke.

The operation of manipulating the movable piece 71 is explained first.

When the control portion 74 of the movable piece 71 is pulled outward from the state shown in FIG. 2, the bent portion 75 of the movable piece 71 shifts the dry ice accommodating receptacle 40 toward the inner wall of the inner receptacle 20, and when the dry ice accommodating receptacle 40 comes into contact with the inner wall of the inner receptacle 20, the hook portion 64 of the fixed piece 61 interlocks with the slit 43 in the dry ice accommodating receptacle 40, and the bent portion 75 of the movable piece 71 is pulled out from the slit 44 of the dry ice accommodating receptacle 40. As shown in FIG. 8, when the bent portion 75 of the movable piece 71 is pulled out from the slit 44, the movable piece 71 side of the dry ice accommodating receptacle 40 drops into the water storage portion 3 of the water tank 10, and with the hook portion 64 of the fixed piece 61 still interlocked with the slit 43 of the dry ice accommodating receptacle 40, the fixed piece 61 side of the dry ice accommodating receptacle 40 does not drop.

The following explains how the tabletop white smoke generator 1 with this function is used.

First, with the dry ice accommodating receptacle 40 separated from the fixed piece 61 and the movable piece 71, the warm water 2 is filled into the water storage portion 3 of the water tank 10, and dry ice 4 (see FIG. 9) is placed into the dry ice accommodating receptacle 40. Next, the fixed piece 61 and the movable piece 71 are inserted into the slits 43 and 44, respectively, of the dry ice accommodating receptacle 40 to attach the dry ice accommodating receptacle 40 to the fixed piece 61 and the movable piece 71. A tray 5 (see FIG. 9) on which, for example, a decoration cake 6 (see FIG. 9) is placed, is arranged on the spacers 31, 32, and 33 of the flange 24. Before the movable piece 71 is operated, the dry ice 4 in the dry ice accommodating receptacle 40 and the warm water 2 in the water tank 10 are not in contact, so that white smoke (water vapor) is not generated.

Next, when for example the control portion 74 of the movable piece 71 is pulled manually outward, the movable piece 71 is dislodged from the slit 44 of the dry ice accommodating receptacle 40, as described above, and as shown in FIG. 9, the movable piece 71 side of the dry ice accommodating receptacle 40 is dropped into the warm water 2 in the water storage portion 3 of the water tank 10. When this happens, the warm water 2 infiltrates the dry ice accommodating receptacle 40 via the slits 45, and the warm water 2 and the dry ice 4 react with one another to generate large quantities of white smoke (water vapor) 7. The white smoke 7 passes between the flange 24 and the tray 5 and gushes out onto the table and spreads out around the decoration cake 6 and the tabletop white smoke generator 1. The large amount of white smoke that gushes out onto the tabletop as described above is water vapor, so it spreads out below the tray 5 as shown in FIG. 9, and does not come down upon the cake that is on the tray 5.

Here, for the dry ice 4, a variety of suitable possibilities are available, including using the dry ice provided in the packaging for the decoration cake 6 to preserve the cake.

According to this embodiment, because the empty portion 13 for vacuum thermal insulation is formed in the inside portion of the bottom portion 11 and the side wall 12 in the water tank 10 of the tabletop white smoke generator 1, the empty portion 13 makes it more difficult for heat to transfer from the inner to the outer side than does thermal insulation material, thermal insulation effects for the hot water used for generating smoke with the dry ice can be sufficiently obtained, the table is not negatively impacted by the heat, nor do water drops adhere to the out side of the water tank 10, so that an unpleasant impression can be prevented.

Figure 10:
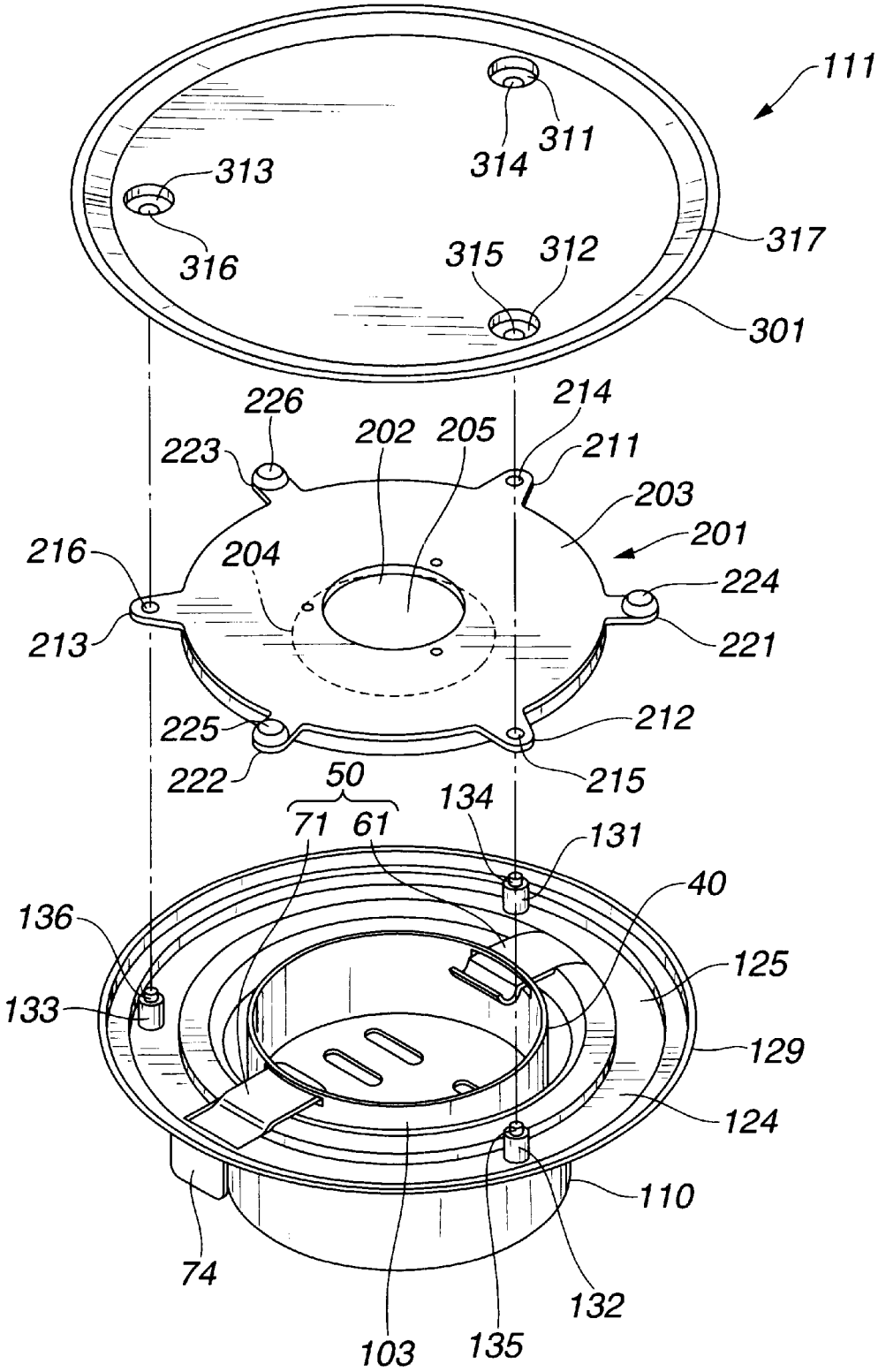
FIG. 10 is an exploded perspective view of a second embodiment of the tabletop white smoke generator according to the present invention.
Figure 11:
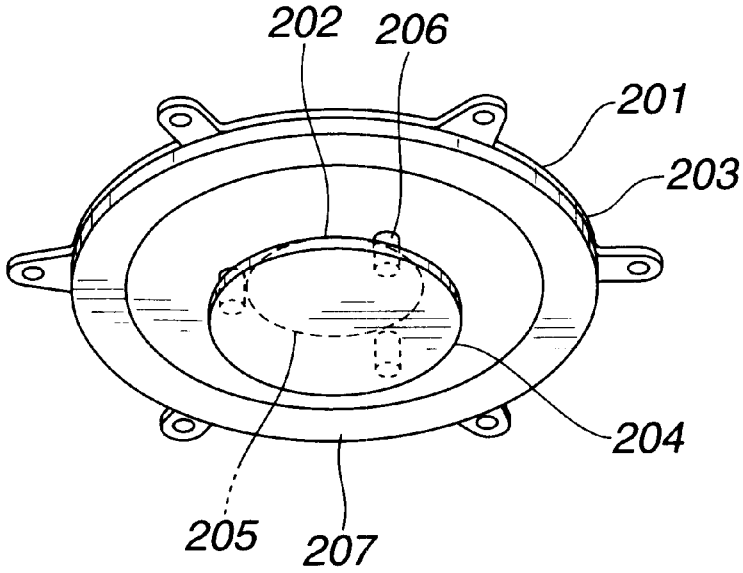
FIG. 11 is a perspective view of the water drop prevention plate of FIG. 10 seen from the bottom.
Figure 13:
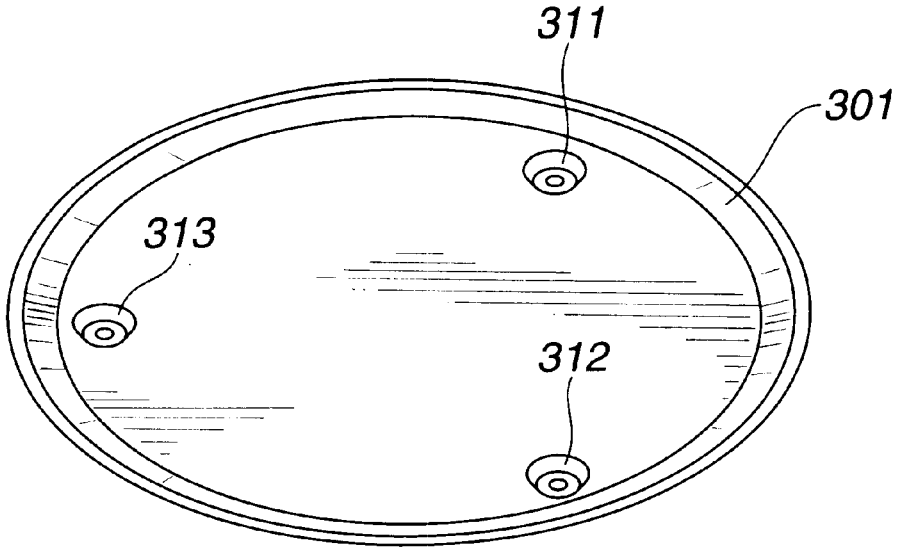
FIG. 13 is a perspective view of the tray of FIG. 10 seen from below.
Figure 12:
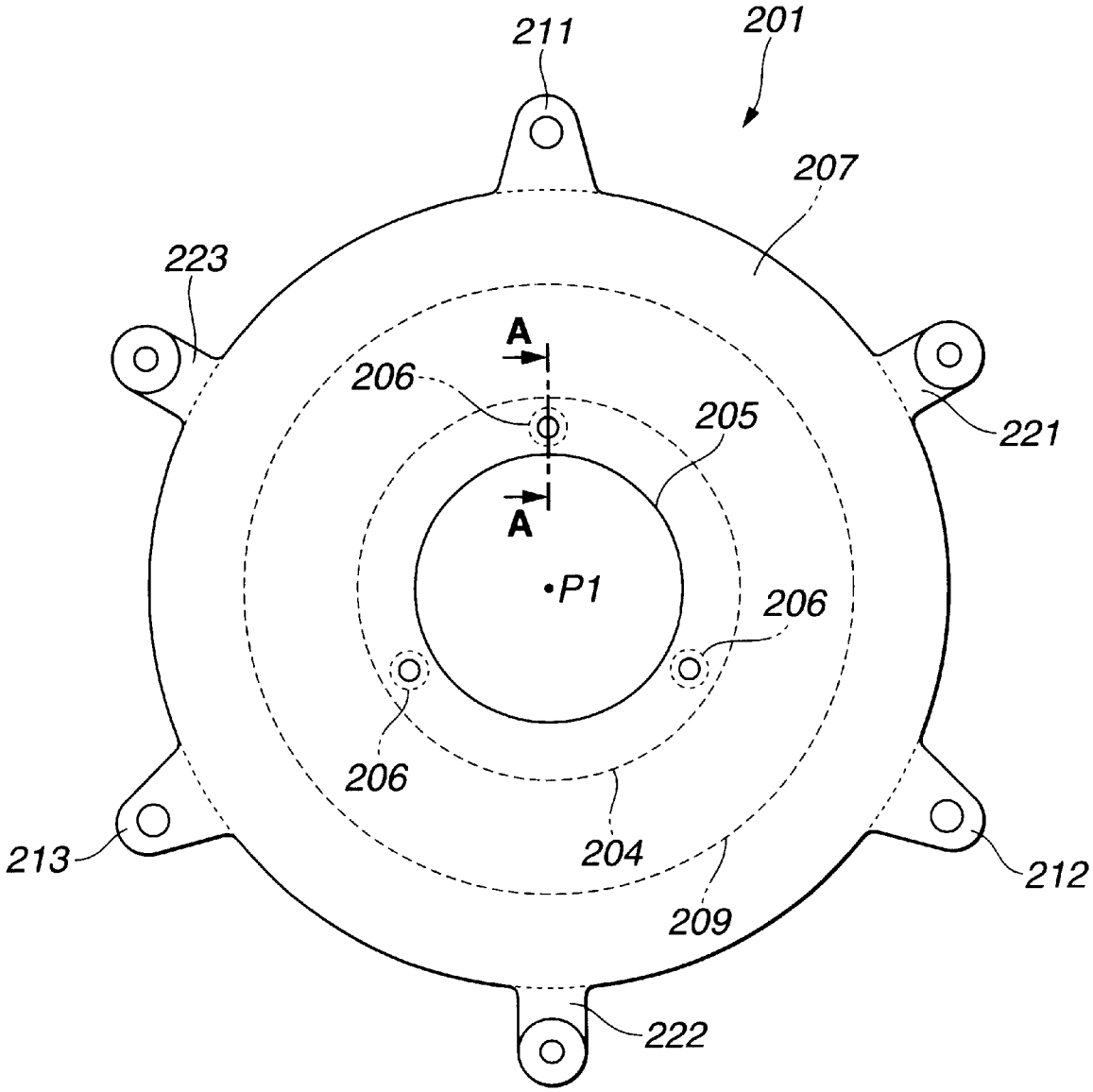
FIG. 12 is a top view of the water drop prevention plate of FIG. 10.
Figure 14:
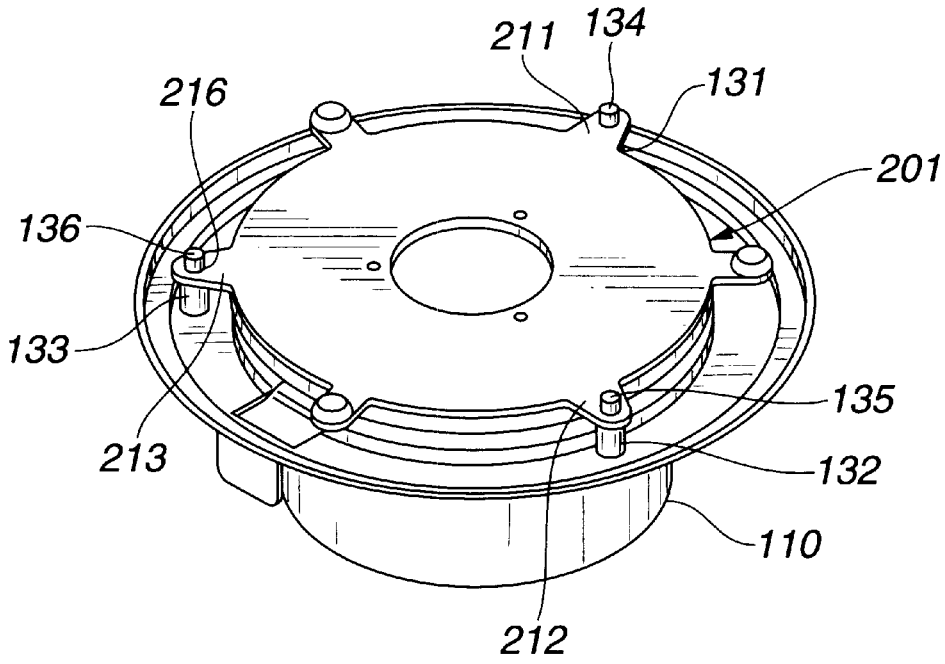
FIG. 14 is a perspective view showing the water drop prevention plate attached to the water tank of FIG. 10.
Figure 15:
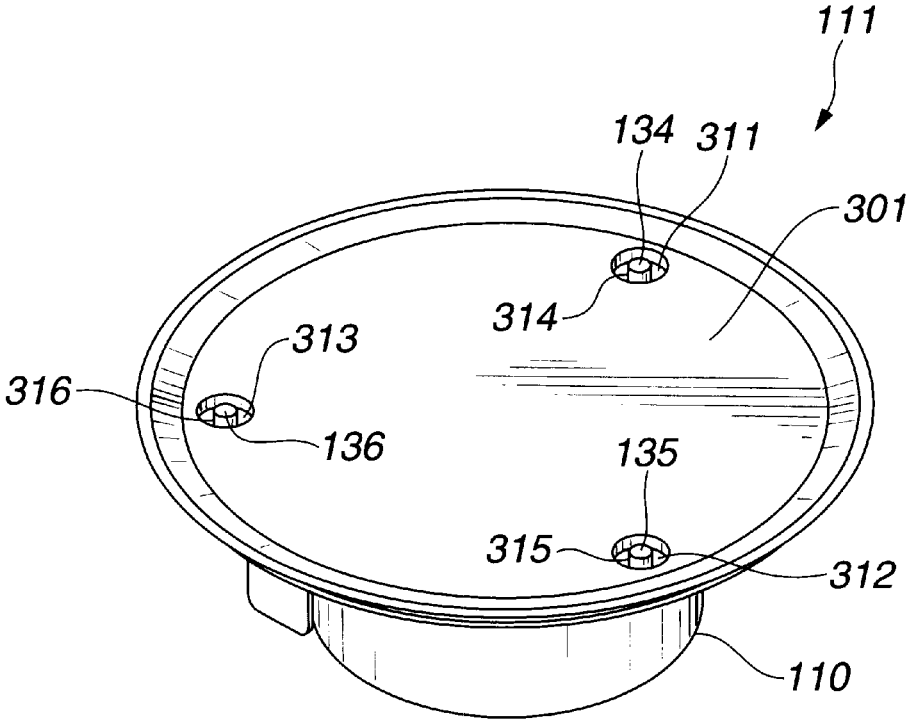
FIG. 15 is a perspective view showing the assembled tabletop white smoke generator of FIG. 10.
Figure 16:
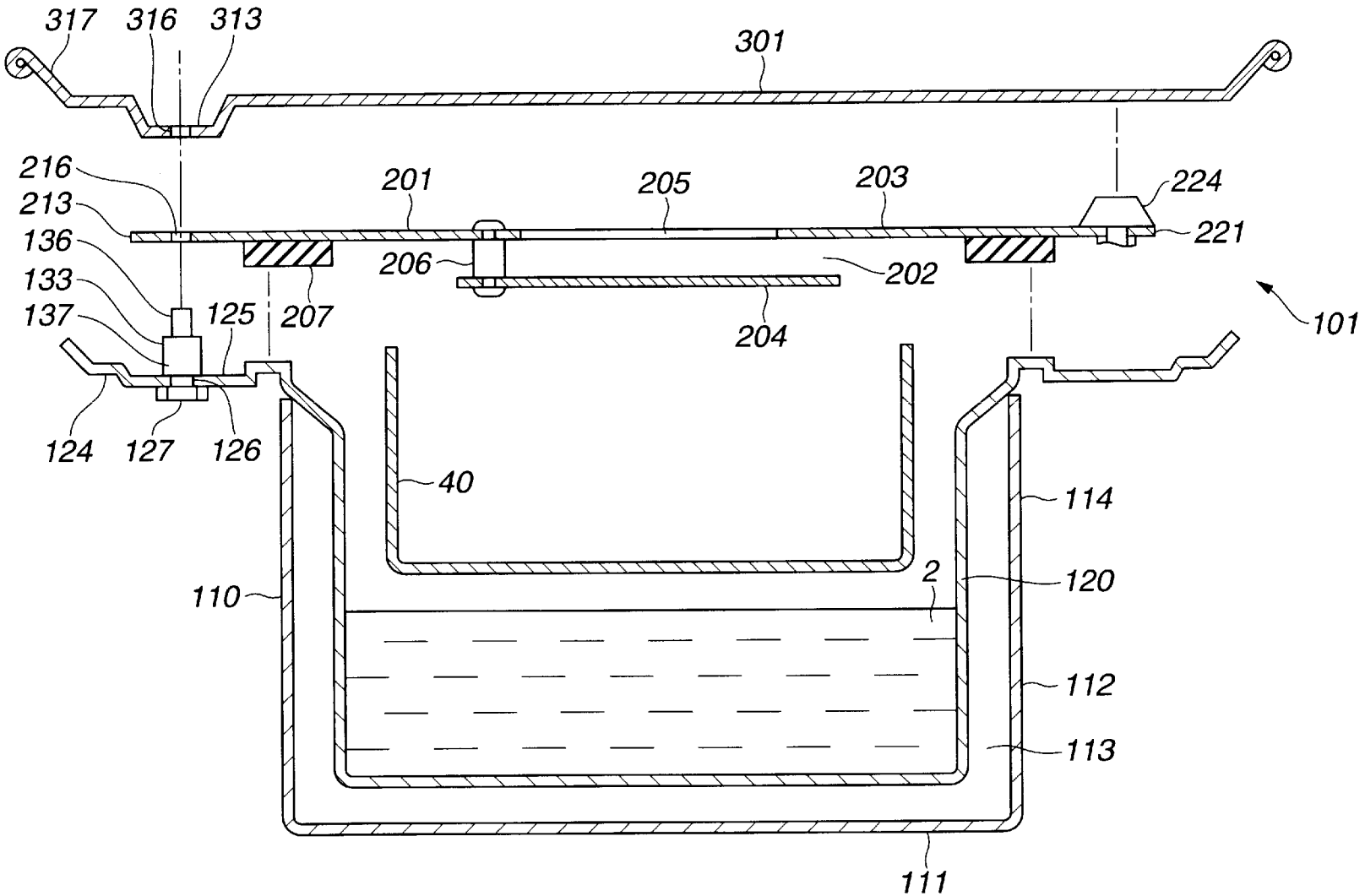
FIG. 16 is a cross-sectional view of the tabletop white smoke generator of FIG. 10, exploded and seen from the side.
Figure 17:
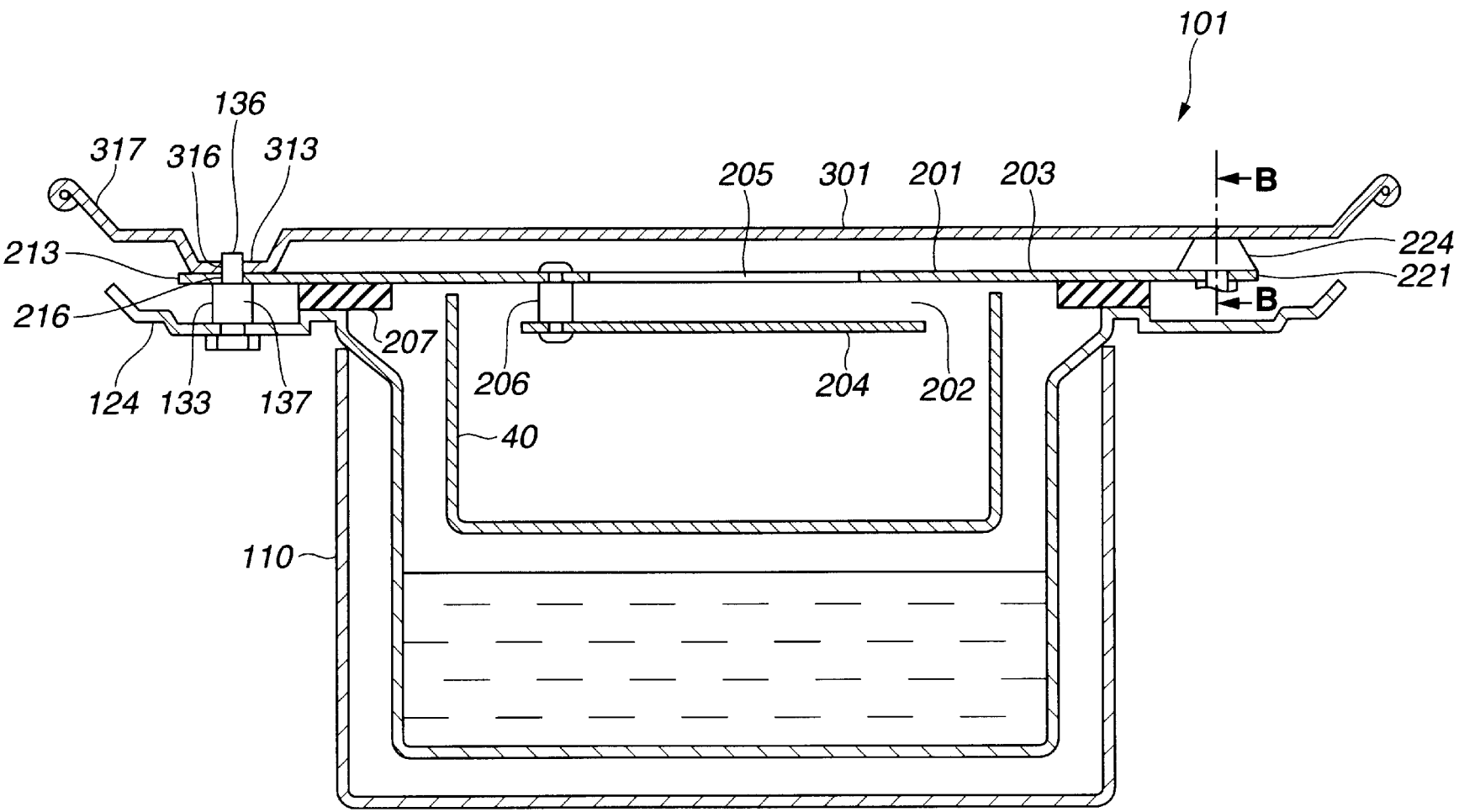
FIG. 17 is across-sectional view of the assembled tabletop white smoke generator of FIG. 10 seen from the side.
Figure 18:
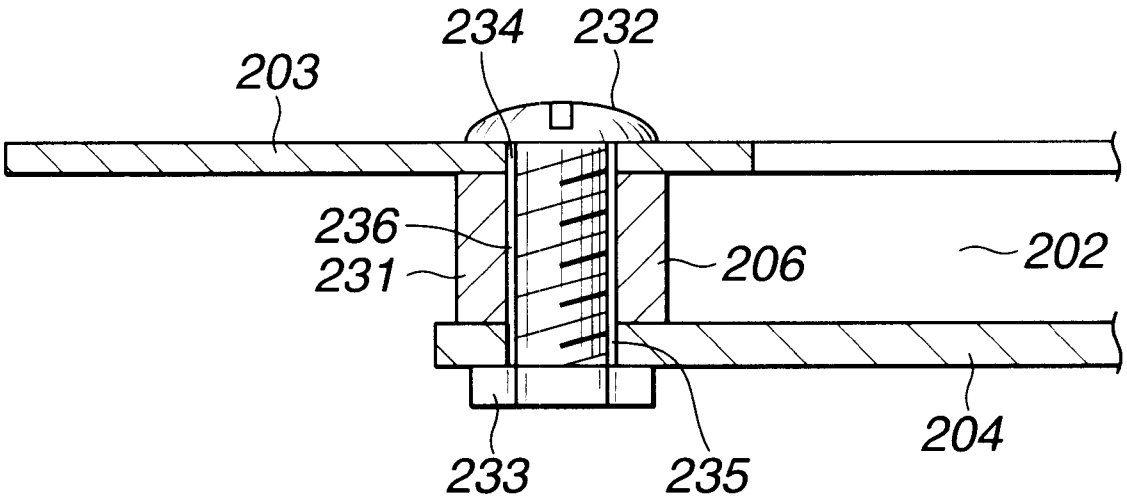
FIG. 18 is a cross-sectional view taken along line A—A of FIG. 12.
Figure 19:
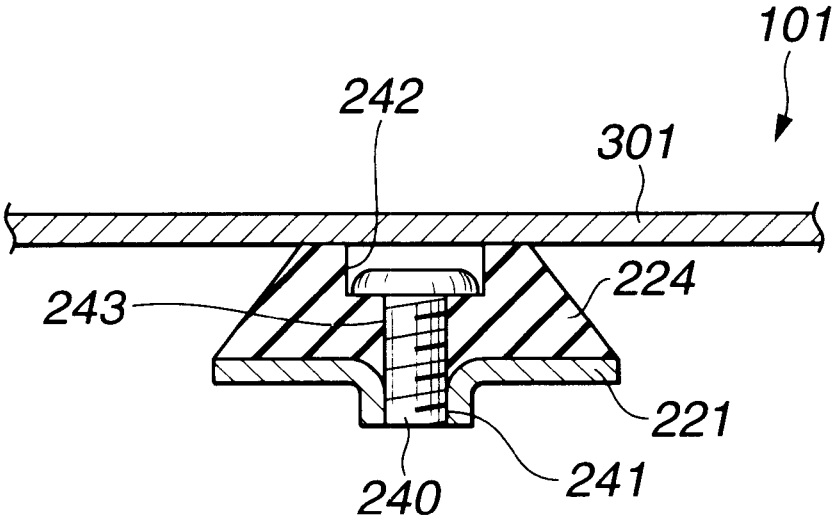
FIG. 19 is a cross-sectional view taken along line B—B line of FIG. 17.

FIG. 10 through FIG. 19 show a second embodiment of a tabletop white smoke generator according to the present invention. FIG. 10 is an exploded perspective view of the tabletop white smoke generator, FIG. 11 is a perspective view of a water drop prevention plate seen from the bottom, FIG. 12 is a top view of the water drop prevention plate, FIG. 13 is a perspective view of the tray seen from the bottom, FIG. 14 is a perspective view showing the water drop prevention plate attached to the water tank, FIG. 15 is a perspective view showing the assembled tabletop white smoke generator, FIG. 16 is a cross-sectional view of the tabletop white smoke generator, exploded and seen from the side, FIG. 17 is a cross-sectional view of the assembled tabletop white smoke generator seen from the side, FIG. 18 is a cross-sectional view taken along the line A—A of FIG. 12, and FIG. 19 is a cross-sectional view taken along the line B—B line of FIG. 17.

In FIG. 10, a tabletop white smoke generator 101 includes a water tank 110, a dry ice accommodating receptacle 40, a holding portion 50, a water drop prevention plate 201, and a tray 301.

The dry ice accommodating receptacle 40 and the holding portion 50 have the same structure as in the embodiment shown in FIG. 1 through FIG. 9. The dry ice accommodating receptacle 40 is positioned and supported above a water storage portion 103 of the water tank 110 by the holding portion 50.

An upward slanting edge portion 129 is formed at the outer circumference of a flange portion 124 of the water tank 110. A ring shaped stepped portion 125 that bulges downward is formed in the flange portion 124 of the water tank 110 at an intermediate portion thereof. Metal tray supports 131, 132, and 133 are provided at predetermined locations on the upper surface of the stepped portion 125.

The water drop prevention plate 201 is plate-shaped and is disposed above the water tank 110 in which the dry ice accommodating receptacle 40 is accommodated. Additionally, the water drop prevention plate 201, with its plate surface, prevents water drops generated when the dry ice is submerged in the hot or cold water filled into the water tank 110 from splashing upwards, and the water vapor that is generated at this time is passed horizontally and then guided upwards by a gap 202 formed in the water drop prevention plate 201.

A more detailed explanation follows below. The water drop prevention plate 201 includes two large and small disk-like plate members 203 and 204 arranged on top of each other via the gap 202, and the center of the plate member 203 is shaped into an aperture portion 205 for guiding vapor from the gap 202 upwards. The plate members 203 and 204 are made of stainless steel.

The outer circumference of the plate member 203 is provided with tongues 211, 221, 212, 222, 213, and 223. The tongues 211, 212, and 213 are provided with through holes 214, 215, and 216, respectively, into which tip portions 134, 135, and 136 of the tray supports 131, 132, and 133 are respectively inserted. Tray receiving rubber seats 224, 225, and 226 are attached to the upper surface of the tongue 221, 222, and 223, respectively.

The tray 301 is made of stainless steel and is disk-shaped, with downward bulging circular indentations 311, 312, and 313 formed into the tray 301 in locations corresponding to the tray supports 131, 132, and 133, respectively. Through holes 314, 315, and 316, into which the tip portions 134, 135, and 136 of the tray supports 131, 132, and 133 are inserted, are formed in the bottom portion of the indentations 311, 312, and 313, respectively. Additionally, an edge portion 317 that slants upwards is formed at the outer circumference of the tray 301.

The water drop prevention plate 201 is explained in detail below with reference to FIG. 11 and FIG. 12

As shown in FIG. 11 and FIG. 12, the smaller plate member 204, which forms the gap 202 with three rod-shaped attachment members 206, is attached to the bottom surface of the larger plate member 203 such that their centers coincide. The smaller plate member 204 hides the aperture portion 205 when the water drop prevention plate 201 is viewed directly from below. A ring-shaped spacer 207 is attached to the edge of the bottom surface of the plate member 203. The spacer 207 is made of an elastic material (in the case of the present embodiment, rubber).

As shown in FIG. 12, the plate members 203 and 204, and the spacer 207, are formed in concentric circles with respect to a central axis P1. The tongues 211, 221, 212, 222, 213, and 223 are attached to the outer circumference of the plate member 203 at an equal spacing clockwise to the right. The three attachment members 206 are attached to the perimeter of the aperture portion 205 of the plate member 203 at an equal spacing.

The bottom of the tray 301 is explained next with reference to FIG. 13.

As shown in FIG. 13, the circular indentations 311, 312, and 313 formed in the tray 301 protrude downward from the bottom surface of the tray 301.

The state in which the water drop prevention plate 201 is attached to the water tank 110 is described next using FIG. 14.

As shown in FIG. 14, to attach the water drop prevention plate 201 to the water tank 110, the tip portions 134, 135, and 136 of the tray supports 131, 132, and 133 are inserted into the through holes 214, 215, and 216, which are formed in the tongues 211, 212, and 213. Thus, the water drop prevention plate 201 covers the water storage portion 103 of the water tank 110 shown in FIG. 10 from above. The tip portions 134, 135, and 136 of the tray supports 131, 132, and 133 protrude upward from the tongues 211, 212, and 213 through the through holes 214, 215, and 216.

The state in which the tray 301 is attached to the water tank 110, which is in turn attached to the water drop prevention plate 201, is described below with reference to FIG. 15.

As shown in FIG. 15, to attach the tray 301 to the water tank 110, the tip portions 134, 135, and 136 sticking out from the tongues 211, 212, and 213 as shown in FIG. 14 are inserted into the through holes 314, 315, and 316 that are formed in the indentations 311, 312, and 313 of the tray 301. Thus, the tray 301 is securely attached to the water tank 110.

A detailed description of the tabletop white smoke generator 101 follows below.

As shown in FIG. 16, the water tank 110 includes a vacuum empty portion 113, which is formed to the inside of a bottom portion 111 and a side wall 112. The inner portion of this receptacle is capable of accommodating warm (hot) water 2. The water tank 110 is formed in a single unit by welding an outer receptacle 114 and an inner receptacle 120.

The smaller plate member 204 of the water drop prevention plate 201 is smaller than the storage portion of the dry ice accommodating receptacle 40, but is larger than the aperture portion 205 of the larger plate member 203. The attachment members 206 are attached closer to the outer circumference of the smaller plate member 204 than the aperture portion 205 of the plate member 203.

The spacer 207 of the water drop prevention plate 201 is an elastic member that has been formed into a ring shape, with an outer circumference that is substantially the same size as the inner diameter of the stepped portion 125 of the water tank 110, and an inner diameter that is smaller than the inner diameter of the flange portion 124 of the water tank 110.

The tray support 133 forms the smaller diameter tip portion 136 at one end of a larger diameter column portion 137, and a threaded hole is formed in the end face of the other end of the column portion 137. A through hole 126 is formed in the stepped portion 125 of the water tank 110. The threaded portion of a bolt 127 is inserted into the through hole 126 of the stepped portion 125 from below, and screwing the bolt 127 into the threaded hole at the other end side of the column 137 fastens the tray support 133 to the stepped portion 125.

The tip portion 136 of the tray support 133 is inserted into the through hole 216 of the tongue 213 and the through hole 316 of the stepped portion 313 in order from below. The tongue 221, onto which the tray receiving rubber seat 224 is attached, is provided on the side opposite the tongue 213, through which the through hole 216 is formed, of the water drop prevention plate 201. This is the same with the other tray supports 131 and 132. The outer perimeter of the edge portion 317 of the tray 301 is rounded downwards and in on itself.

As shown in FIG. 17, when the tabletop smoke generator 101 is assembled, by inserting the tip portion 136 of the tray support 133 into the through hole 216 of the tongue 213 of the water drop prevention plate 201 and the through hole 316 of the stepped portion 313 of the tray 301, the water drop prevention plate 201 and the tray 301 can be attached to the water tank 110 without sideways movement by either member. In this situation, the tongue 213 of the water drop prevention plate 201 is in contact with the column portion 137 of the tray support 133 and is supported from below, and the stepped portion 313 of the tray 301 is in contact with the tongue 213 of the water drop prevention plate 201 and is supported from below. The tray receiving rubber seat 224, which is attached to the tongue 221, supports the bottom surface of the tray 301 from below.

The side inward from the stepped portion 125 of the flange portion 124 of the water tank 110 is in close contact with the spacer 207 of the water drop prevention plate 201. Thus, water drops and water vapor do not seep out from between the flange portion 124 and the plate member 203 of the water drop prevention plate 201.

Next, the attachment members 206 are described in detail with reference to FIG. 18.

In FIG. 18, the attachment members 206 are made of a tubular member 231, a screw 232, and a nut 233. Through holes 234 and 235 are formed in the plate members 203 and 204. The through holes 234 and 235 are formed smaller than the outer diameter of the tubular members 231.

The threaded portion of the screw 232 is pushed from above through the through hole 234 of the plate member 203, the through hole 236 of the tubular member 231, and the through hole 235 of the plate member 204, and is screwed into the groove of the nut 233. Thus, the attachment members 206 fasten the plate members 203 and 204 via the gap 202.

The tongue 221 of the water drop prevention plate 201 and the tray receiving rubber seat 224 are described below with reference to FIG. 19.

The tray receiving rubber seat 224 has an outer perimeter that tapers off in an upward direction and shaped like a cone. A recess portion 242 is formed into the upper side of the tray receiving rubber seat 224, and a through hole 243 is formed in a downward direction from the bottom of the recess portion 242.

A female groove portion 241 is formed into the tongue 221. The threaded portion of a screw 240 is inserted into the through hole 243 of the tray receiving rubber seat 224 and screwed into the female groove portion 241 to screw down and fasten the tray fastening rubber seat 224 to the tongue 221. Moreover, the head of the screw 240 is inserted into the recess portion 242, and does not stick out above the tray receiving rubber seat 224.

With this structure, when the tabletop smoke generator 101 has been assembled, the upper side of the tray receiving rubber seats 224 is in close contact with the bottom surface of the tray 301 and can stabilize and support the tray 301 from below.

The tabletop white smoke generate of this embodiment is operated as described below.

When the movable piece 71 of the holding portion 50 is operated to submerge the dry ice accommodating receptacle 40 and the dry ice together into the warm or hot water filled into the water tank 110, the warm water 2 and the dry ice 4 react to generate white smoke (water vapor), and this white smoke passes through and gushes out from the gap 202 between the plate members 203 and 204, the aperture portion 205 of the plate member 204, and the gap between the plate member 204 and the tray 301, and spreads out in the vicinity below the tray 301 on which a decoration cake, for example, has been arranged.

In this case, the water drops that form when the dry ice is submerged in the cold or warm water in the water tank 110 cannot pass through the gap 202, and thus are prevented from splashing outside by the plate surface of the plate members 203 and 204.

As described above, according to the present embodiment illustrated in FIGS. 10 to 19, in the same way as in the embodiment of FIG. 1, heat from the hot water is not transferred to, nor do water drops adhere to, the outer surface of the water tank 110, so that an unpleasant impression is prevented. Furthermore, one achieved effect is that it is possible to prevent drops of water, which form when the dry ice is submerged in the hot or cold water in the water tank 110, from splashing outside of the tabletop smoke generator 101.

It should be noted that in the embodiments of FIGS. 1 to 19, the water tank was made of stainless steel, but it can also be made with another highly corrosion resistant metal such as a titanium alloy. Additionally, in the embodiments of FIGS. 1 to 19, hot water was used as the liquid for generating dry ice white smoke because with it large amounts of smoke can be reliably produced, but cold water can also be used as the liquid for generating dry ice smoke, in which case the outside surface of the water tank 10 becomes cold, and as described above, water drops can be prevented from adhering to that outside surface.

Having described the preferred embodiments of the invention referring to the accompanying drawings, it should be understood that the present invention is not limited to those precise embodiments and various changes land modifications thereof could be made by one skilled in the art without departing from the spirit or scope of the invention as defined in the appended claims.

What is claimed is:

1. A tabletop white smoke generator, which can be placed on a table and which generates dry ice white smoke, comprising:

a water tank that is made of metal and in the form of a receptacle with an open upper side, the water tank having vacuum thermal insulation surrounding the bottom and sidewall so that hot or cold water can be filled into the receptacle;

a dry ice accommodating receptacle that has an open upper side, the dry ice accommodating receptacle being of a size that can be accommodated within the water tank so that dry ice can be accommodated in the receptacle; and a holding portion, which holds the dry ice accommodating receptacle above the hot or cold water in the water tank, and which, with a specific operation, can submerge the dry ice accommodating receptacle into the hot or cold water that has been filled into the water tank.

2. A tabletop white smoke generator, which can be placed on a table and which generates dry ice white smoke, comprising:

a water tank that is made of metal and in the form of a receptacle with an open upper side, the water tank having vacuum thermal insulation surrounding the bottom and sidewall so that hot or cold water can be filled into the receptacle;

a flange extending outward from the top of the water, tank, on which a tray can be set providing a gap for discharging the generated white smoke in a horizontal direction;

a dry ice accommodating receptacle that has an open upper side, the dry ice accommodating receptacle being of a size that can be accommodated within the water tank so that dry ice can be accommodated in the receptacle; and a holding portion, which holds the dry ice accommodating receptacle above the hot or cold water in the water tank, and which, with a specific operation, can submerge the dry ice accommodating receptacle into the hot or cold water that has been filled into the water tank.

3. The tabletop white smoke generator according to claim 2, wherein the holding portion is provided with a fixed piece which is fixed to the flange of the water tank, and a movable piece which is slideably provided on the flange of the water tank;

wherein the fixed piece and the movable piece are inserted into and interlocked with slits in the dry ice accommodating receptacle, and hold the dry ice accommodating receptacle above water in the water tank; and wherein when the movable piece is slid to move the dry ice accommodating receptacle to an inner wall side of the water tank, and the dry ice accommodating receptacle abuts on the inner wall of the water tank, the movement of the dry ice accommodating receptacle is stopped but the movable piece continues to slide and disengages from the slit in the dry ice accommodating receptacle, thereby releasing its grip on the dry ice accommodating receptacle and dropping the dry ice accommodating receptacle into the water tank.

4. The tabletop white smoke generator according to claim 2, wherein the tray that is arranged on the flange of the water tank providing a gap for discharging the white smoke is a general purpose tray.

5. The tabletop white smoke generator according to claim 2, wherein the tray that is arranged on the flange of the water tank providing a gap for discharging the white smoke is fixed by a fixing member.

6. The tabletop white smoke generator according to claim 5, wherein the fixed tray can be used as a tray rest for resting a general purpose tray.

7. The tabletop white smoke generator according to claim 2, wherein the flange is provided with a gap-forming member for arranging the tray while providing a gap for discharging the white smoke on the flange of the water tank.

8. The tabletop white smoke generator according to claim 3, wherein the dry ice accommodating receptacle has slits at least on its bottom portion for allowing the hot or cold water to flow into the receptacle.

9. The tabletop white smoke generator according to claim 2, wherein drops of water, which are generated when the dry ice is submerged in the hot or cold water that has been filled into the water tank, are prevented from splashing upwards by a water drop splash prevention member, which is disposed above the water tank in which the dry ice accommodating receptacle is held.

10. The tabletop white smoke generator according to claim 9, wherein a gap is formed in the water drop splash prevention member for guiding the created water vapor upwards after having the water vapor pass in a horizontal direction.

* * * * *